United States Patent [19]

Matthews et al.

[11] 4,313,273

[45] Feb. 2, 1982

[54] FIREARMS AND LASER BEAM AIM ASSISTING METHODS AND APPARATUS

[75] Inventors: John W. Matthews, Fountain Valley; Michael J. Fraer, Sierra Madre, both of Calif.

[73] Assignee: Laser Products Corporation, Fountain Valley, Calif.

[21] Appl. No.: 33,285

[22] Filed: Apr. 25, 1979

[51] Int. Cl.[3] ..... F41G 1/34

[52] U.S. Cl. ..... 42/1 A; 42/71 P; 42/84

[58] Field of Search ..... 42/1 A, 66, 70 E, 84, 42/71 P, 72; 362/110, 113

[56] References Cited

U.S. PATENT DOCUMENTS

| | | | |
|---|---|---|---|
| 689,547 | 12/1901 | James | 42/1 A |
| 870,272 | 11/1907 | Burton | 42/1 ST |
| 894,306 | 7/1908 | Wright | 362/110 |
| 1,149,705 | 8/1915 | Ward | 42/1 A |
| 1,229,721 | 6/1917 | Cooke | 42/72 |
| 1,452,651 | 4/1923 | Norrlin | 42/1 A |
| 1,641,019 | 8/1927 | Woods | 42/1 ST |
| 1,826,004 | 10/1931 | Key | 362/110 |
| 1,993,979 | 3/1935 | Reed | 362/113 |
| 2,225,583 | 12/1940 | Blizard | 42/70 E |
| 2,510,289 | 6/1950 | Livermore | 42/1 ST |
| 2,597,466 | 5/1952 | Felix | 42/1 ST |
| 2,660,794 | 12/1953 | Goortz et al. | 33/49 |
| 2,664,797 | 1/1954 | Thrasher | 42/1 R |
| 2,693,031 | 11/1954 | Clark | 33/49 |
| 2,844,710 | 7/1958 | Zinnser | 42/1 A |
| 2,912,566 | 11/1959 | Cornett | 362/110 |
| 3,010,019 | 11/1961 | Sohst | 250/83.3 |
| 3,153,856 | 10/1964 | Felix | 42/1 ST |
| 3,294,401 | 12/1966 | Nicholas et al. | 273/101.1 |
| 3,508,833 | 4/1970 | Waldhaver, Jr. | 356/152 |
| 3,533,700 | 10/1970 | Alexander | 356/138 |
| 3,619,069 | 11/1971 | Alexander | 356/138 |
| 3,633,285 | 1/1972 | Sensney | 33/25 |
| 3,667,849 | 6/1972 | Appler et al. | 356/152 |
| 3,701,213 | 10/1972 | Lewis | 42/66 |
| 3,782,832 | 1/1974 | Hacskaylo | 356/153 |
| 3,796,496 | 3/1974 | Appler et al. | 356/138 |
| 3,823,313 | 7/1974 | Unemo | 33/275 R |
| 3,867,764 | 2/1975 | Dunmire et al. | 42/1 A |
| 3,898,747 | 8/1975 | Marshall | 35/25 |
| 3,904,204 | 9/1975 | Yokoi | 273/101.1 |
| 3,938,262 | 2/1976 | Dye et al. | 35/25 |
| 3,974,585 | 8/1976 | Dunham | 42/1 S |
| 3,995,376 | 12/1976 | Kimble et al. | 35/25 |
| 4,026,054 | 5/1977 | Snyder | 42/1 A |
| 4,079,534 | 3/1978 | Snyder | 42/1 A |
| 4,152,754 | 5/1979 | de Filippis et al. | 42/1 A |
| 4,161,076 | 7/1979 | Snyder | 42/1 A |
| 4,168,588 | 9/1979 | Snyder | 42/1 A |

FOREIGN PATENT DOCUMENTS

| | | | |
|---|---|---|---|
| 492773 | 4/1919 | France | 42/1 A |
| 1015421 | 7/1952 | France . | |
| 66753 | 12/1913 | Switzerland . | |

*Primary Examiner*—Charles T. Jordan

*Attorney, Agent, or Firm*—Benoit Law Corporation

[57] ABSTRACT

A firearm has a firing device, a manually cockable and selectively releasable hammer for actuating the firing device and a selectively activable laser beam emitting device for providing an aiming mark on a target of the firearm. The laser beam emitting device is activated through cocking of the hammer to provide the aiming mark. The cocked hammer is released with a finger trigger for actuation of the firing device only after activation of the laser beam emitting device and provision of the aiming mark.

41 Claims, 11 Drawing Figures

FIREARMS AND LASER BEAM AIM ASSISTING METHODS AND APPARATUS

BACKGROUND OF THE INVENTION

1. Field of the Invention

The subject invention relates to firearms, to firearm aiming assistance technology, and to laser systems and, more specifically, to firearms equipped with devices for providing an aiming mark on a target, to methods and apparatus for assisting the aiming of a firearm, and in particular to methods and apparatus for assisting the aiming of a firearm with a light beam from a laser.

2. Disclosure Statement

This disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness, and inasmuch as a growing attitude appears to require citation of material which might lead to a discovery of pertinent material.

For over seventy years, proposals have been made for assisting the aiming of firearms with light beams or light spots on targets. Reference may, for instance be had to U.S. Pat. No. 894,306, which proposes clamping of an elongate light source, including a small electric incandescent lamp and a projection lens, to the barrel of a handgun, U.S. Pat. No. 1,452,651, which proposes clamping of a flashlight to a handgun barrel, U.S. Pat. Nos. 1,826,004 and 2,844,710 which propose clamping of an electric incandescent lamp and battery unit to a handgun, aand U.S. Pat. Nos. 3,010,019 and 3,974,585 which also propose employment of electric incandescent lamps for providing aiming marks on firearm targets or on an optical sight.

Practical limitations on light output intensity and coherence achievable with incandescent lamps have relegated the utility of such proposals to nightsight or target finder equipment of rather limited range.

Aim assistance electric incandescent lamps also have found a limited application in reticle image projectors of complex computing sights, as may be seen from U.S. Pat. Nos. 2,660,794 and 2,693,031. Apart from such special applications, the use of electric incandescent light aiming assists for firearms appears to have become restricted to aim assessment apparatus, as seen in U.S. Pat. No. 3,508,833.

Further proposals were spawned by the development of laser diodes comparable in size and ruggedness to small incandescent light bulbs (see U.S. Pat. No. 3,867,764). The utility of laser diodes as aiming devices was, however, generally limited to marksmanship trainer, boresight alignment, weapon simulator and similar applications, as may, for instance, be seen from U.S. Pat. Nos. 3,633,285, 3,782,832, 3,898,747, 3,938,262 and 3,995,376.

The success of gas discharge lasers in the surveying instrument field illustrated, for instance, by U.S. Pat. Nos. 3,533,700, 3,619,069, 3,667,849, 3,796,496 and 3,823,313, similarly spawned proposals to use that type of laser in weapon aiming systems. As apparent from U.S. Pat. No. 4,026,054, an early proposal of this type structured a laser aiming system in the manner of firearm telescope sights, seen, for instance, in U.S. Pat. Nos. 870,272, 1,641,019, 2,510,289, 2,597,466 and 3,153,856, and also in French Pat. No. 492,773 by Albert Amigues and Louis Huet, issued 2 Apr. 1919.

In the course of this development spanning seven decades, there has been a continuous quest for the best method of activating the aiming assistance or sighting appliance at the most appropriate moment in the operation of the firearm. In this context, the above mentioned U.S. Pat. No. 894,306 provided an electric switch controlled by a manually actuable button at the back of the revolver stock or handle. In practice, this required the operator to contiously actuate the switch in a manner separate from the operation of the firearm, thereby occupying or even detracting the operator's attention. In principle, the proposals according to the above mentioned U.S. Pat. Nos. 1,452,651, 1,826,004, 3,974,585 and 4,026,054, which provide actuating switch means on or at the sighting appliance or its power supply, are afflicted with the same kind of disadvantage.

Another proposal, disclosed in the above mentioned U.S. Pat. No. 2,844,710, attempted to alleviate this problem by equipping the finger trigger of a firearm with a spring carrier having an electric switch contact attached thereto and standing normally insulated from the trigger but in juxtaposition to its finger grip. In the use of that firearm, pressure on the spring carrier closed an electric circuit through its contact and trigger, to energize an electric bulb for projection of a spot of light in the direction in which the firearm was aimed at the time. While such a construction may have seemed to provide an activation mechanism that is convenient to operate by the marksman, it is noted that the proposed spring carrier just mentioned constitutes in effect a foreign object on the finger trigger, is subject to being bent out of shape and is easily dislodged during handling and operation of the firearm. Also, that proposal according to the mentioned U.S. Pat. No. 2,844,710 does not appear to disclose any positive safeguard against accidental firing of the weapon by a marksman who merely wants to test the operation of the aiming device or draw a bead on a target, such as for warning purposes, without wanting to fire a shot.

Out of these concerns and similar considerations, use of finger trigger switches has become relegated to the toy pistol field and to weapon fire simulation systems, in which light beams are protected from a toy pistol or simulated weapon upon actuation of the finger trigger to photocells on a target, as may be seen from the above mentioned U.S. Pat. Nos. 3,294,401, 3,898,747 and 3,995,376.

This, of course, is akin to proposals which employ a trigger-actuated switch for connecting a light detector in a simulated weapon to an indicator for aim assessment or scoring purposes, as proposed in the above mentioned U.S. Pat. Nos. 3,508,833 and 3,904,204. In principle, such proposals are in effect only an extension of marksmanship training and weapon simulators which use the acoustical energy developed by the firearm mechanism, as proposed in the above mentioned U.S. Pat. No. 3,633,285 or a piezoelectrically transduced mechanical energy from a rifle's hammer as proposed in the above mentioned U.S. Pat. No. 3,938,262, for the purpose of simulating the firing of a shot by the emission of a laser beam.

Against this background, the above mentioned recent U.S. Pat. No. 4,079,534 proposes the assembly of the sighting apparatus and its power supply in a separate unit which is attachable to the firearm as desired. According to that proposal, a special trigger mechanism, separate and distinct from the trigger mechanism of the firearm, has its own separate finger grip disposed adjacent the finger grip of the firearm, for operating a switch mechanism on a shockproof mount for activating the light emitting device. Thus when it is desired to activate the light emitting device to project a beam of coherent light onto a target that is to be fired upon, movement of the special finger grip of the separate trigger mechanism will cause closing of the switch contacts that supply current to the light emitting device; the express purpose of this prior-art design being to project a beam onto the target when the marksman is ready to fire a round.

In practice, however, there is frequently a need to warn a supposed criminal or wrongdoer, hopefully with the result of avoiding a shooting confrontation. Laser beam aiming devices capable of providing a vivid light spot that cannot fail to impress even a seasoned criminal, tend to have such a preventive effect that danger to life and limb can be avoided. Of course, this presupposes that the police officer or similar law enforcement personnel can be sure that his firearm will not go off when he trains the aiming device on a suspect. No teaching appears from the latter prior-art proposal that such assurance is implicit in the proposed dual finger grip arrangement. Also, a dual finger grip and trigger mechanism arrangement tends to duplicate bulk, costs and maintenance requirements of the firearm and laser aiming device combination.

Especially in police and law enforcement work, bulk and frangibility are particularly detrimental factors in the fight against crime, where weapons often become clubs in hand-to-hand combat or other tight situations.

Laser aiming devices should thus in practice be as compact and rugged as the firearm itself, in order to be of genuine practical use and desired reliability. This also applies to the power supply, including the portable power source and its combination with the firearm. Despite a history spanning some seven decades, the prior art apparently has not been capable of evolving a viable solution in this respect.

In particular, the above mentioned U.S. Pat. No. 894,306 simply proposes a relative large cylindrical battery to be screwed into the butt of the firearm at a threaded terminal portion, whereby the cylindrical battery body simply hangs down from the stock of the weapon. It is not seen how such a combination could be useful for law enforcement purposes or would even be suitable for private use. The same comment appears applicable to the proposals according to which batteries are located in the sighting equipment itself, as shown, for instance, in the above mentioned U.S. Pat. Nos. 1,452,651, 1,826,004 and 2,844,710.

Even though the last twenty years have seen substantial increases in battery power capacity, proposals to accommodate a battery in the handgrip have been limited to the target game field, such as in the above mentioned U.S. Pat. No. 3,294,401, where such a battery energizes a flash tube in a toy gun for illuminating photocell targets, and to the marksman training field, where a battery in the stock of a weapon energizes a small solid state laser device for training purposes, as apparent from the above mentioned U.S. Pat. No. 3,995,376. Particularly the low power consumption of laser diodes and similar solid-state devices permits accommodation of the requisite low-energy batteries in the laser transmitter assembly, aiming light adapter or simulated firearm structure itself. However, such designs using only laser diodes are generally relegated in their utility to the marksmanship training and weapon fire simulation fields, as appears from the above mentioned U.S. Pat. Nos. 3,633,285, 3,867,764 and 3,898,747.

For applications involving actual firearms with relatively powerful laser aiming assistance devices, separate box-like power supplies attached to the side of the firearm externally thereof, either directly or through the intermediary of an attachment assembly, have been evolved by more recent prior-art endeavor, as may be seen from the above mentioned U.S. Pat. Nos. 4,026,054 and 4,079,534.

This, of course, adds to the bulk of the weapon system and detracts from its ruggedness and to some extent also from its smooth operation.

SUMMARY OF THE INVENTION

It is a general object of this invention to overcome disadvantages and satisfy needs expressed or implicit in the disclosure statement herein set forth.

It is a related object of this invention to provide improved firearms and weapon systems.

It is a germane object of this invention to provide improved laser aiming systems for firearms.

It is a related object of this invention to provide improved methods and apparatus for assisting the aiming of a firearm with a light beam from a laser.

It is a germane object of this invention to provide improved methods and apparatus for providing aiming marks for firearms and weapon systems.

It is also an object of this invention to provide improved aiming device and laser power supply systems for firearms.

It is also an object of this invention to provide improved methods and apparatus for selectively activating aiming devices and lasers for firearms.

Other objects will become apparent in the further course of this disclosure.

From a first aspect thereof, the subject invention resides in a method of operating a firearm having a firing device selectively actuable by a manually cockable hammer and a finger trigger for actuating the hammer and for releasing the cocked hammer for actuation of the firing device, with the aid of an aiming device activable via a switch to provide when activated an aiming mark on a target. More specifically, the invention according to this aspect resides in the improvement comprising, in combination, the steps of providing a switch with switch control means, coupling the trigger to the switch control means for deactivating the aiming device in a rest position of the trigger, manually cocking the hammer and decoupling the trigger from the switch control means for starting activation of the aiming device through the manual cocking of the hammer to provide the aiming mark, and releasing the cocked hammer with the finger trigger for actuation of the firing device only after activation of the aiming device and provision of the aiming mark.

From another aspect thereof, the subject invention resides in a method of operating a firearm having a firing device selectively actuable by a hammer and a finger trigger for actuating the hammer, with the aid of an aiming device activable via a switch to provide when activated an aiming mark on a target. More specifically, the invention according to this aspect resides in the improvement comprising, in combination the steps of providing a switch with switch control means, coupling the trigger to the switch control means for deactivating the aiming device in a rest position of the trigger, manually moving the finger trigger relative to the hammer, starting activation of the aiming device with the moving finger trigger by decoupling the moving trigger from the switch control means to provide the aiming mark, and actuating the hammer with the finger trigger only after activation of the aiming device and provision of the aiming mark.

From another aspect thereof, the subject invention resides in a method of aiming a firearm having a firing mechanism actuated by a manually actuable trigger, with the aid of an aiming device activable via a switch to provide when activated an aiming mark on a target. Moreover specifically, the invention according to this aspect resides in the improvement comprising in combination the steps of providing the trigger with play between initial manual actuation of the trigger and actuation of the firing mechanism by the trigger, providing a switch with switch control means, coupling the trigger to the switch control means for deactivating the aiming device in a rest position of the trigger, and activating the aiming device with the trigger by decoupling the trigger from the switch control means in the course of the play.

From another aspect thereof, the subject invention resides in a method of operating a firearm with the aid of an energizable aiming device providing an aiming mark on a target and, more specifically, resides in the improvement comprising, in combination, the steps of providing the firearm with a stock having an end portion extending over a cross-section of the stock, and with a butt end portion structured as a natural extension of the stock, extending over the cross-section and being manually detachable from the stock, loading the butt end portion with a replenishable power source for energizing the aiming device, mounting the aiming device on the firearm for provision of the aiming mark on a target of the firearm, and energizing the aiming device from the power source when the butt end portion is attached to the stock.

From another aspect thereof, the subject invention resides in a firearm and, more specifically, in the improvement comprising, in combination, a firing device, means including a trigger and a manually cockable and selectively releasable hammer for actuating the firing device, activable means for providing when activated an aiming mark on a target, a switch for activating the activable means, control means for the switch coupled to the trigger for inhibiting activation of the activable means in a rest position of the trigger, means coupled to the switch control means and to the hammer for starting activation of the aiming mark providing means through manual cocking of the hammer to provide the aiming mark, including means for decoupling the switch control means from the trigger in response to cocking of the hammer, and means including the trigger for releasing the cocked hammer into actuation of the firing device only after activation of the aiming device and provision of the aiming mark.

From another aspect thereof, the subject invention resides in apparatus for assisting the aiming of a firearm having a firing mechanism actuated by a manually actuable trigger, comprising in combination activable means for providing when activated an aiming mark on a target, means at the trigger for providing the trigger with play between initial manual actuation of the trigger and actuation of the firing mechanism by the trigger, and means connected to the activable means and coupled to the trigger for activating the aiming mark providing means, including a switch for activating the activable means, control means for the switch coupled to the trigger for inhibiting activation of the activable means in a rest position of the trigger, and means for decoupling the switch control means from the trigger to activate the aiming mark providing means in the course of the play.

From another aspect thereof, the subject invention resides in a firearm and, more specifically, in the improvement comprising, in combination, an energizable aiming device for providing an aiming mark on a target, means for mounting the aiming device on the firearm, a stock for the firearm having an end portion extending over a cross-section of the stock, means for receiving a replenishable power source for energizing the aiming device, including a hollow butt end portion in the shape of a natural extension of the stock extending over the cross-section and being manually detachable from the stock, means for mounting the aiming device on the firearm for provision of the aiming mark on a target of the firearm, and means connected to the aiming device for energizing the aiming device from the power source when the butt end portion is attached to the stock.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
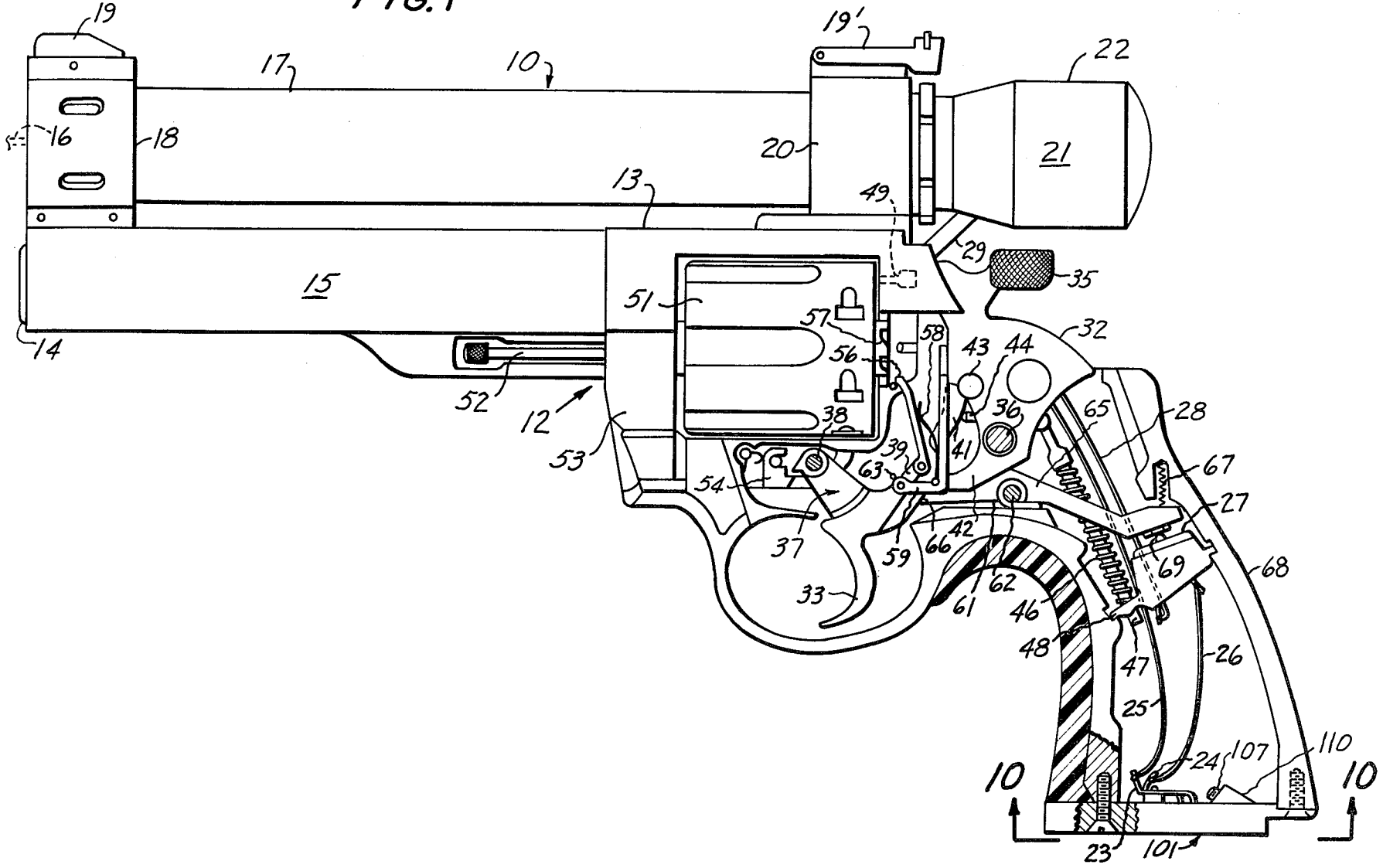
FIG. 1 is a side view, partially in section, of a firearm equipped with a laser beam aiming assistance system according to a preferred embodiment of the subject invention.

The laser beam aiming assistance equipment 10 according to the illustrated preferred embodiment of the subject invention shown in FIG. 1 may be mounted on or used in conjunction with a basically conventional firearm 12, such as a Colt double action revolver 12, having a frame 13 and a barrel 14 threaded therein and projecting therefrom in the form of a barrel assembly 15. The aiming assistance equipment 10 preferably employs a gas laser for emitting, when activated, a laser beam 16 providing an aiming mark in the form of a light spot on a target of the firearm. By way of example, a suitable laser is the helium-neon laser employing electrical glow discharge excitation.

A tubular member 17 of the laser assembly 10 is mounted by a sleeve-like mounting member 18 on the barrel assembly 15 at the location of a front sight 19 and by a mounting member 20 on the frame 13 at the location of a rear sight 19'. The requisite laser pumping or excitation high-voltage supply and ballast 21 is located in a housing 22 attached to an end of the tubular member 17 of the laser assembly 10. The supply and ballast 21 is energized from a battery or other suitable power source described more fully in connection with FIGS. 8 to 11 hereof. In particular, electric supply current is applied via terminals 23 and 24 and leads 25 and 26, respectively, to the ballast 21 and to an electric switch 27. In practice, the power supply 21 may be distributed over the housing 22 and the hollow space in the stock 68, with the high-voltage supply being, for example, located in the stock and the ballast in the housing 22.

Upon closure of the normally open switch 27, electric current proceeds from the lead 26 via a lead 28 to the supply 21. In particular, the leads 25 and 28 may be led to the ballast 21 via a cable 29.

According to the preferred embodiment of the subject invention illustrated in FIGS. 1 to 4, activation of the laser assembly and emission of the laser beam 16 may be started through manual cocking of a hammer 32 and through movement of a finger trigger 33 prior to any release of the hammer 32 to a firing position.

For a more complete understanding of the nature and exact function of these features of the subject invention, the following review of the mechanism of the firearm 12 may be helpful.

In particular, the hammer 32 of the firearm 12 has a manually engageable grip plate or hammer spur 35 by means of which the user of the firearm can cock the hammer, using, for instance, his thumb for this purpose. A pivot pin 36 projects from the frame of the firearm and pivotally mounts the hammer 32 for manual cocking or for other angular movement.

It is a feature of the subject invention that activation of the aiming device 10 is started already during manual cocking of the hammer to provide the aiming mark, notably through the agency of the emitted laser beam 16, as more fully described below. This is an important feature of the currently discussed aspect of the subject invention, which is novel and innovative relative to all the prior art which either relied on the actuation of a switch independently of any operation of the firearm as such or which depended on direct manual action on the trigger or on a manually engageable switching device closely associated therewith.

In this manner, the marksman is automatically provided with the important aiming assistance of the device 10 at such times of danger or imminent action as justify a manual cocking of the hammer through the grip plate 35.

The finger trigger 33 is part of a trigger assembly 37 which is pivoted about a pin 38 projecting from the frame of the firearm. The trigger assembly 37 includes an extension 39 of the trigger 33 for actuating the hammer through a hammer strut 41 and for releasably retaining the hammer 32 upon manual cocking via grip plate 35.

The strut 41 is pivoted for angular movement relative to the hammer 32 by a pin 43 located in a corresponding cavity in the hammer 32. The strut 41 is biased away from the hammer proper to a rest position by a spring-biased pin 44 projecting from the foot of the extension 42. A main spring 46 biases the hammer 33 to its rest position shown in FIGS. 1 to 3 with the aid of a main spring guide 47 extending through a main spring seat 48. The main spring 46 also thrusts the hammer 32 against the firing pin 49 of the firearm upon actuation of the hammer 32 by the trigger 33 or upon release of the previously cocked hammer upon actuation of the finger trigger 33.

In particular, the hammer 32 may be actuated with the finger trigger 33 by angular movement of the trigger assembly 37 about the pivot 38 until the trigger assembly extension 39 engages in the hammer strut 41 and thereupon angularly moves the hammer via that strut about the pivot pin 36 through continued digital engagement and movement of the finger trigger 33.

In the course of such hammer movement, the main spring 46 is tensioned and the trigger assembly 39 eventually slides off the strut 41, whereupon the hammer 32 is released for rapid angular movement into striking engagement with the firing pin 49, propelled by the bias of the tensioned main spring 46.

The ammunition for the firearm is retained in a cylinder 51 which has an ejector 52 and crane assembly 53 associated therewith. A cylinder lock assembly 54 releasably retains the cylinder 51 in any one of six angular positions, in the case of a six-shooter. The trigger assembly 37 releases the cylinder lock assembly 54 preparatory to each advance of the cylinder 51 via a pawl or hand 56 pivotally connected to the extension 39 of the trigger assembly 37. In particular, the cylinder 51 has a ratchet extension 57, the teeth of which are successively engaged by the hand 56, which for that purpose is biased by a hand spring 58.

The hand spring 58, in turn, is carried by a safety connector 59 which is pivotally mounted on the trigger assembly 37 as shown in FIG. 1.

Figure 2:
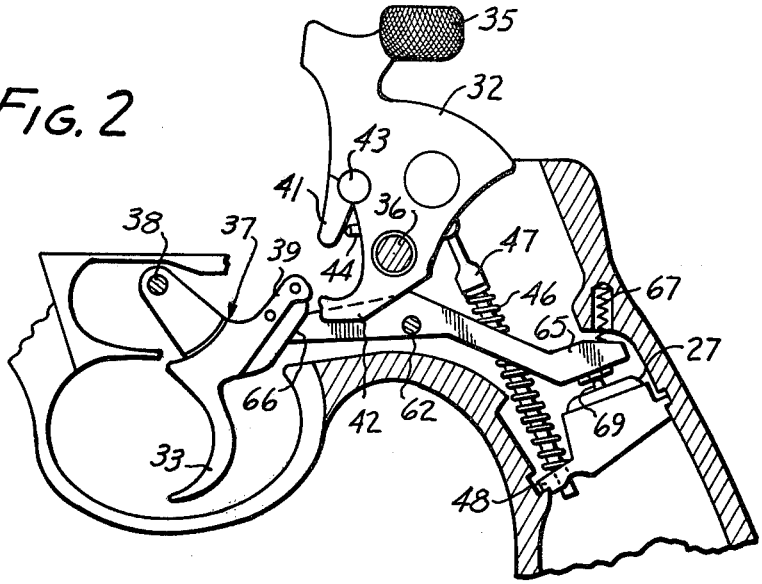
FIG. 2 is a fractional view showing part of the firearm and laser beam aiming assistance system according to FIG. 1 in a rest position.

The trigger assembly 37, and thus the finger trigger 33, is biased to its rest position shown in FIGS. 1 and 2 by a trigger return spring 61 which has a portion wound about a pin 62 projecting from the firearm frame 13. An end portion of the return spring 61, that extends through a corresponding bore or hole in the trigger assembly 37, is visible in FIG. 1 at 63.

It is an important feature of the subject invention that the aiming device 10 is actuated for provision of an aiming mark prior to any release of the hammer 32 from a manually cocked position and prior to any other actuation of the hammer 32 by the manually squeezed finger trigger 33.

To this end, the illustrated preferred embodiment of the subject invention shown in FIGS. 1 to 4 provides a switch-actuating lever 65 that extends from the trigger assembly 37 to the power supply switch 27 and that is pivoted for angular movement about the pin 62. The trigger assembly 37 has a cam surface or element 66 engageable with a first end of the pivoted lever 65. In the rest position of the finger trigger 33 shown in FIGS. 1 and 2, the trigger assembly 37 engages the adjacent end portion of the lever 65 via its cam surface 66 and thus maintains the lever 65 in its extreme angular position against the bias of a spring 67 inserted in and projecting from the stock 68 of the firearm or from a frame portion at such stock.

The power supply switch 27 is of a normally open type, having a spring-biased actuator or plunger 69 projecting from the switch proper in the open condition of the switch. Accordingly, the power supply switch 27 is maintained open, and the power supply source or battery is thus maintained disconnected from the laser device and ballast assembly 21, whereby operation of the laser aiming device is suspended in the quiescent condition of the firearm. To this end, the bias of the trigger return spring 61 acts via trigger assembly 37 and cam surface 66 to maintain the pivoted lever 65 against the bias of the spring 67 away from the switch 27 thereby maintaining the switch 27 open.

The switch 27, in turn, is conveniently housed in an appropriate extension of the main spring seat 48 for reliable actuation as presently to be described, and for reliable deactivation when the firearm is not in use.

Figure 3:
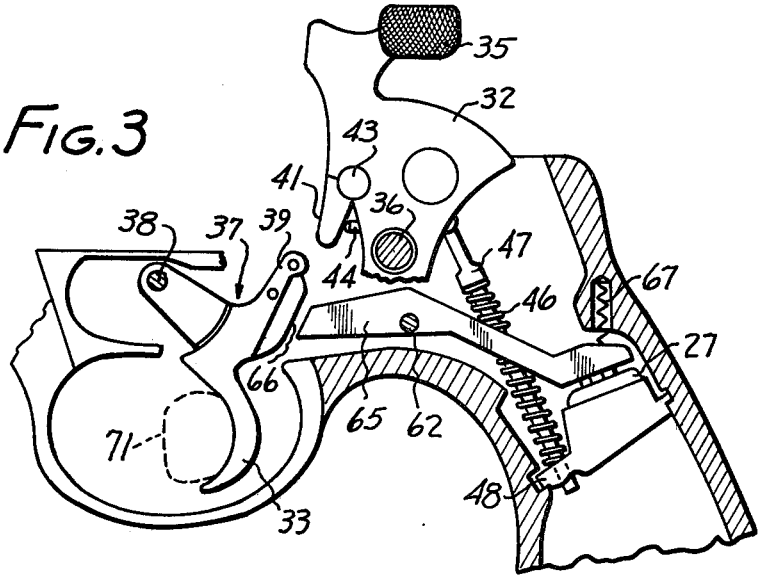
FIG. 3 is a view similar to FIG. 2, showing part of the firearm and laser beam aiming assistance system according to FIG. 1 in a more advanced condition.
Figure 4:
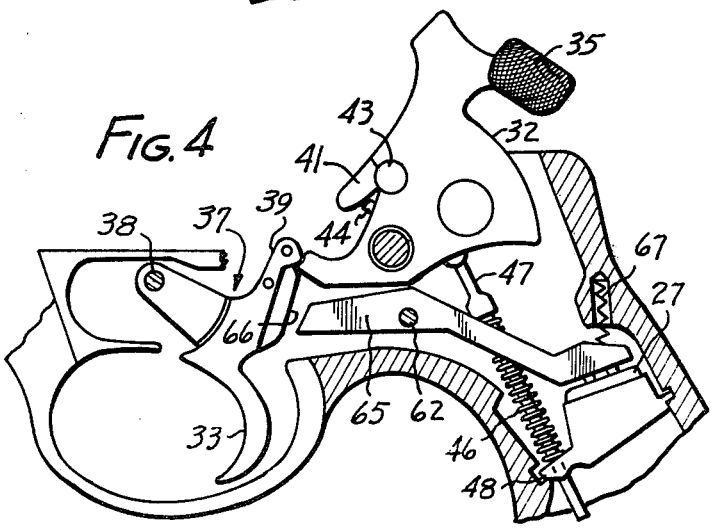
FIG. 4 is a view similar to FIGS. 2 and 3, showing part of the firearm and laser beam aiming assistance system according to FIG. 1 in another advanced condition.

As soon as the trigger assembly 37 is being moved counterclockwise about the pivot 38 as seen in FIGS. 3 and 4, closure of the switch 27 is initiated.

In particular, and as shown in FIG. 3, the user of the firearm manually moves the trigger 33 and trigger assembly 37 with his trigger finger 71 relative to the frame 13 and hammer 32. This quickly disengages the cam surface or element 66 from the lever 65 upon manual actuation of the trigger assembly, by lifting the cam surface 66 off the lever 65 well before the trigger assembly extension 39 engages and moves the hammer strut 41. The disengaged lever 65 is thus immediately swung clockwise as seen in FIG. 3 by the bias of the spring 67, and thereby depresses the plunger 69 and closes the power supply switch 27 at the main spring seat 48. This connects the ballast and high-voltage assembly 21 to the power supply or battery already connected to the spring terminals 23 and 24 (see FIGS. 8 to 11). Accordingly, the laser device 10 is immediately activated and emits a laser beam 16 which provides the desired aiming mark on the target of the firearm well prior to any actuation of the firing mechanism for the firing of any bullet or, for that matter, without necessity of any firing at all, is not desired at the time.

In case firing of the revolver 12 becomes necessary after provision of the aiming mark by the laser beam 16, the marksman may squeeze the trigger 33 beyond the position shown in FIG. 3, whereupon the trigger assembly extension 39 will engage the strut 41 and will actuate the hammer 32 only after activation of the aiming device 10 and provision of the aiming mark.

Sometimes it is desirable or necessary that the firearm be readied for very quick action. Such situations arise, for instance, frequently in law enforement work where police officers are subjected to imminent danger. In that case, the officer may manually cock the hammer 32 against the bias of the main spring 46 through manual engagement of the grip plate or hammer spur 35 and angular movement of the hammer in a clockwise direction as seen in FIG. 4 about the pivot pin 36.

The lower extension 42 of the hammer 32 thus engages and rides on top of a protrusion of the trigger assembly portion 39, thereby moving the trigger assembly 37 and its cam surface 66 away from the lever 65. This, in turn, permits the bias spring 67 to angularly move the lever 65 clockwise as seen in FIG. 4, and to thus close the power supply switch 27 through depression of the plunger 69 via lever 65.

Activation of the aiming device 10 is thus started through manual cocking of the hammer 32 to provide the desired aiming mark.

In the preferred embodiment of the subject invention shown in FIGS. 1 to 4, the trigger 33 or trigger assembly 37 is moved with the hammer 32 through its extension 42 during cocking of that hammer, and the activation of the aiming device 10 is started with such moving trigger or trigger assembly to provide the desired aiming mark through manual cocking of the hammer.

The trigger assembly extension 39 cooperates with a correspondingly shaped portion of the hammer extension 42 in retaining the hammer 32 in a cocked position as shown in FIG. 4. At that point, the aiming device 10 has already been activated and the laser beam 16 thus provides the desired aiming mark on a target of the firearm.

In many instances, provision of an aiming mark through activation of the aiming device 10 has the beneficial effect of rendering the firing of any bullet unnecessary. For instance, if a suspect confronted by a police officer notices the vivid and bright aiming mark as provided by the laser beam 16 on his person, he may realize that he would be the loser in a gun battle and he may then give up his own firearm peacefully. In that case, the hammer 32 is simply uncocked in a conventional manner without firing a shot.

On the other hand, if it becomes necessary to fire the gun from the cocked position shown in FIG. 4, then the police officer or user would simply pull the trigger 33 with his trigger finger, thereby moving the trigger assembly extension 39 off the hammer extension 42 and thus releasing the hammer 32 from its cocked position into engagement with the firing pin 49 under the propulsion of the main spring 46. The hammer 32 is thus released from the cocked position shown in FIG. 4 with the finger trigger 33 only after activation of the aiming device 10 and provision of the aiming mark by the laser beam 16.

In the context of the currently discussed aspect of the subject invention, and particularly in the context of its preferred embodiments shown in FIGS. 1 to 7, it may be said that the trigger is provided with play between initial manual actuation of the trigger and actuation of the firing mechanism by that trigger, and that activation of the aiming device 10 takes place in the course of that play.

For instance, FIGS. 2 and 3 show that there is considerable play between the initial manual actuation of the trigger 33 from the rest position shown in FIG. 2 and the actuation of the firing mechanism by the trigger through engagement of the hammer strut 41 and subsequent release of the hammer 32 into engagement with the firing pin 49. The extent of this play may be seen from a comparison of FIGS. 2 and 3, and it is also seen from FIG. 3 and its above description that the aiming device 10 is activated with the trigger 33 or trigger assembly 37 in the course of the play apparent from FIG. 3.

Figure 5:
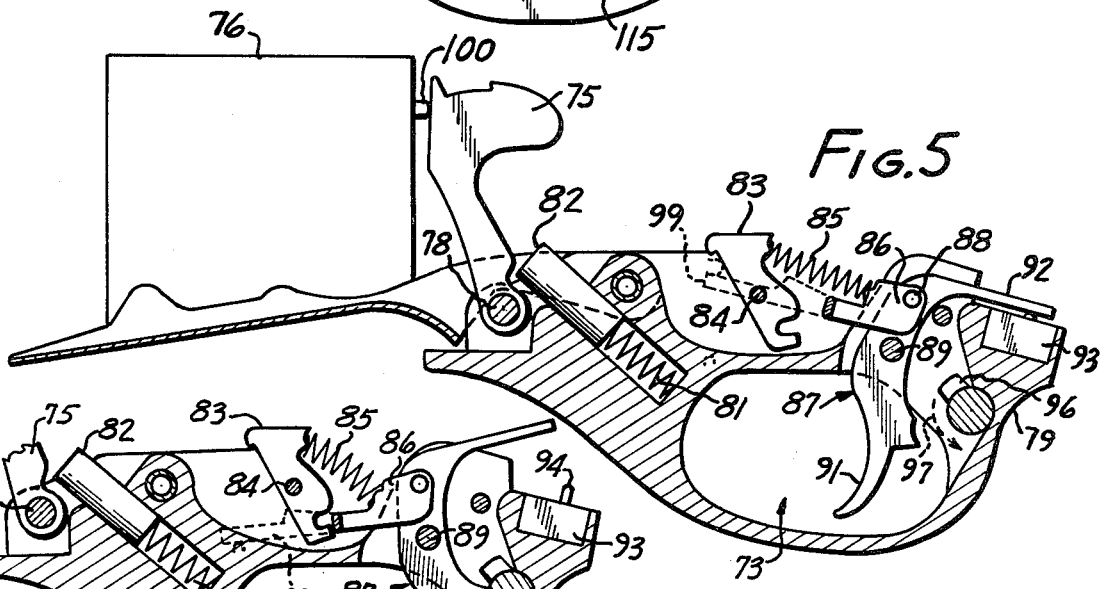
FIGS. 5, 6 and 7 are views similar to FIGS. 2, 3 and 4, showing part of another firearm and laser beam aiming assistance switching device according to a further preferred embodiment of the subject invention in various operating conditions.
Figure 7:
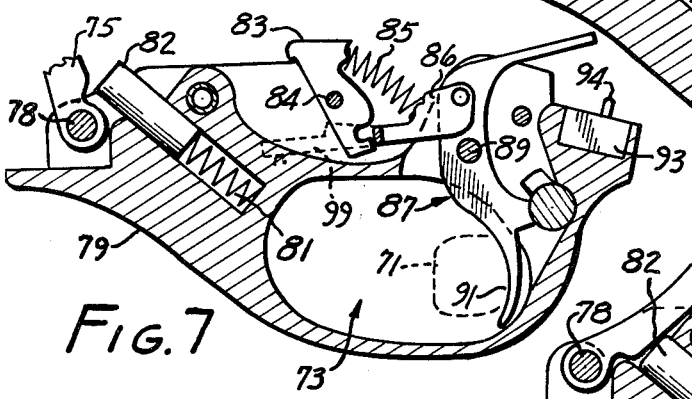
Figure 6:
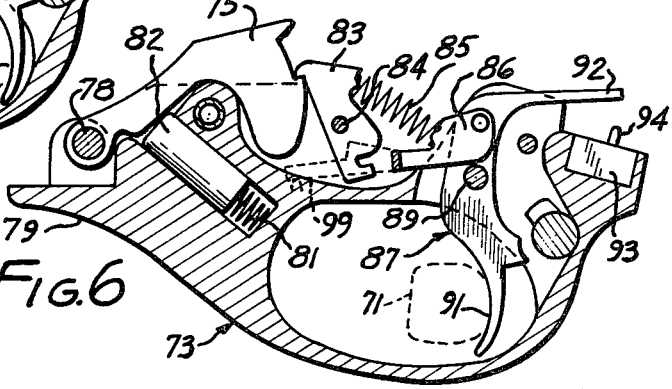

Such is also the principle of the trigger and hammer assembly 73 shown in FIGS. 5 to 7. This assembly 73 may, for example, be used in shotguns and rifles for law enforcement purposes, where such weapons are sometimes known as riot guns. Such weapons sometimes have a very rapid release, sometimes referred to as "hair trigger release," which would engender the danger of accidental firing if their trigger were used for the purpose of activating the aiming device 10 without appropriate modification in accordance with the embodiment of the subject invention.

By way of comparison, FIG. 1 in conjunction with FIG. 4 illustrates an embodiment of the subject invention in which the aiming device 10 is activated through manual cocking of the hammer. While such a feature is highly desirable in many instances, there are other situations where activation of the aiming device 10 by the finger trigger alone would be sufficient.

In the type of weapon in which the assembly 73 shown in FIGS. 5 to 7 is used, a hammer 75 is cocked by pumping the gun or a loading mechanism in the course of loading a chamber 76 with a cartridge.

In particular, the hammer 75 is swung about a pivot pin 78 on the frame 79 against the bias of a spring 81 acting on the hammer 75 via a plunger 82.

The cocked hammer 75 is releasably retained by a latch 83 which is pivoted about a pin 84 and biased in the direction of the hammer by a spring 85. The spring 85 extends between the latch 83 and an actuator device 86 which is pivotally mounted on a trigger assembly 87 at 88.

The trigger assembly, in turn, is pivotally mounted for angular movement about a pin 89 projecting from the frame 79. The trigger assembly has a finger trigger 91 at one end and a projecting latch or lever 92 on the other.

The lever 92 is operatively associated with a power supply switch 93 mounted on the frame 79. Unlike the switch 27 shown in FIGS. 1 to 4, the switch 93, by way of example and not by way of limitation, is of a normally closed type. In other words, the power supply switch 93 is closed when its spring-biased plunger 94 is free to project therefrom as shown in FIGS. 6 and 7, and is open when its plunger is depressed as shown in FIG. 5. In other respects, the aiming device and its power supply may be the same as in the embodiment in FIGS. 1 to 4.

If the frame 79 shown in FIGS. 5 to 7 is a rifle, then the aiming device 10 shown in FIG. 1 may be mounted by mounts 18 and 20 at the underside of the barrel assembly, for example, The batteries or other replenishable power supply may then be housed in the rifle stock. In the rest position of the firearm, or in the rest position of the trigger 91, the spring 85 biases the lever 92 into engagement with the plunger of the switch 93.

The resulting depression of the plunger maintains the switch 93 in an open condition, thereby maintaining the batteries or other power supply disconnected from the ballast and high-voltage assembly of the aiming device.

As seen in FIG. 6 relative to FIG. 5, there is sufficient play between the trigger assembly including its element 89 and the hammer latch 83 to permit the user of the firearm to activate the aiming device and provide the desired aiming mark without any danger that a shot could be released thereby. As seen in FIG. 6, the user of the firearm may employ his trigger finger 71 to move the trigger so as to have the lever 92 release the plunger 94 for a closure of the switch and resulting provision of the aiming mark. For increased safety against accidental firing, a safety stop 96 may be provided for the finger trigger for selectively preventing actuation of the hammer 75 with the trigger 91. That safety stop as such may be conventional. For instance, many firearms have slidable cylindrical devices of different diameters in order to provide a safety stop for the trigger in a first sliding position, and in order to free the trigger for normal actuation in a second sliding position. By way of example, FIG. 5 shows a safety stop 96 which is rotatable into the path of the trigger 91 as indicated by the dotted line 97. If the safety stop 96 is thus in the path of the trigger, then the trigger cannot be actuated to the firing position shown in FIG. 7.

On the other hand, the illustrated embodiment of the subject invention provides sufficient play between the trigger 91 and the safety stop 96 so that the lever 92 can still release the power supply switch 93 for an activation of the aiming device, even if the safety stop is in its active position 97. In other words, actuation of the aiming device is started with the finger trigger 91 in the course of its play during manual actuation of the trigger toward the active safety stop 96. The subject invention and its embodiments are similarly operative with other kinds of firearm safety systems. For instance, the actuating device 86 of the trigger assembly may be provided with a lever extension 99 as indicated in dotted outline in FIGS. 5 to 7. As long as the lever 99 is held upward by some safety device (not shown) of the firearm, the actuator 86 will not be able to rotate the hammer release latch 83. Nevertheless, the trigger assembly 87 will still be rotatable by manual engagement of the finger trigger 91, whereby the power supply switch 93 will be closable, even though the safety lever 99 is in its elevated safety position shown in FIG. 5.

On the other hand, if the safety stop 96 is removed or deactivated, and if the safety lever 99 is in its downward position, then the trigger 91 can be squeezed from its intermediate position shown in FIG. 6 to its firing position shown in FIG. 7, whereupon the actuating element 86 of the trigger assembly will engage and angularly move the latch 83, thereby releasing the hammer 75 for striking impact of a firing pin or device 100 under the bias force of the main spring 81.

A shot may thus be fired from the particular firearm. The trigger 91 may then be released by the user to its rest position whereby the supply of electric power to the aiming device will again be interrupted through opening of the switch 93 as shown in FIG. 5.

It is thus seen that both the embodiment of FIGS. 1 to 4 and the embodiment of FIGS. 5 to 7 include means for providing a lost motion connection between the finger trigger 33 or 91 and the hammer 32 or 75. On the other hand, the embodiment of FIGS. 1 to 4 also couples means 27 and 65 for starting activation of the aiming device to the hammer 32 via the trigger 33 or trigger assembly 37.

The embodiments of FIGS. 1 to 7 further include a hammer 32 or 75 having an actuating member 41 or 83 located at a distance from the trigger or trigger assembly 37 or 87 for engagement and actuation by the trigger or members 39 or 86 thereof. A pin 38 or 89 pivots the trigger for travel through the latter distance into engagement with the actuating member 41 or 83, either directly or, as shown, via an extension 39 of the trigger assembly 37 or a pivoted element 86 of a trigger assembly 87. The activating means of the aiming device 10 include means 27 and 65 or 92 and 93 for activating the aiming mark providing device upon initiation of the latter travel.

Reference will now be had to FIGS. 1 and 8 to 11 for the purpose of disclosing a suitable power supply in accordance with a further aspect of the invention.

In particular, the firearm 12 has a handle portion or stock including an end portion 101 extending over a cross-section of the stock 68.

Figure 8:
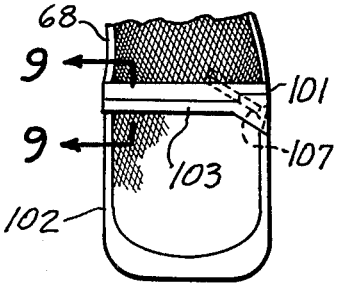
FIG. 8 is a detail view, on a smaller scale, of a power supply system that may be used in accordance with a further preferred embodiment of the subject invention with the firearm according to FIG. 1.

According to a preferred embodiment of the invention, and as illustrated in FIG. 8, a receptacle 102 for receiving a replenishable power source for activating the aiming mark providing means 10, is shaped in the form of, and includes, a hollow butt end portion extending over the cross-section of the stock end portion 101 and being manually detachable from the stock 68.

As seen in FIG. 1, the aiming device activating means include, for instance, a power supply switch 27 and an actuating lever 65 therefor, coupled to the trigger 33 or trigger assembly 37 for energizing the aiming mark providing means 10 from the power source in the butt end portion 102, such as in the course of the play between the trigger and the hammer extensions or portions 41 and 42, when the butt end portion 102 is attached to the stock 68.

Within the broad scope of the currently discussed aspect of the subject invention, the structured butt end portion power supply device may, of course, be employed with aiming devices having actuating mechanisms different from those shown in FIGS. 1 to 7. In fact, this power supply may even be used for different electrically energizing aiming devices for real or simulated firearms.

In accordance with the illustrated embodiment shown in FIGS. 8 to 11, the butt end portion 102 and the stock 68 include mating means or structured plates 101 and 103 for attachment of the butt end portion 102 to the stock 68 by sliding motion of the butt end portion relative to the stock in a plane extending parallel to the above mentioned cross-section of the stock at 101.

Figure 9:
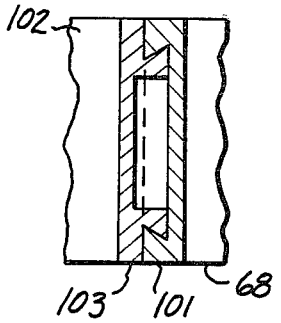
FIG. 9 is a section along the line 9—9 of FIG. 8.
Figure 10:
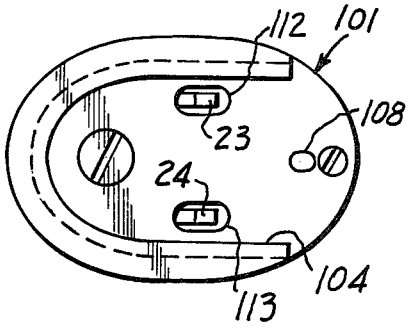
FIG. 10 is a bottom view of the stock portion of the firearm shown in FIG. 1, taken along the line 10—10 in FIG. 1.
Figure 11:
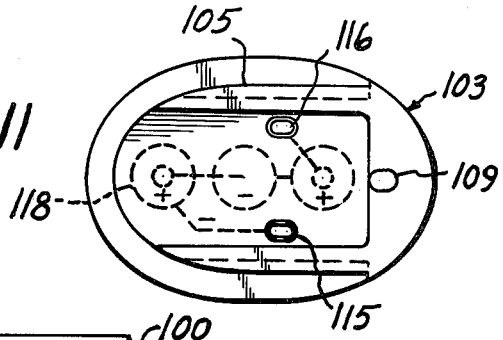
FIG. 11 is a top view of a battery attachment forming the lower part of FIG. 8.

In particular, and as seen in FIGS. 9 to 11, the stock 68 and butt end portion 102 include mating dovetail portions 104 and 105 on the plate 101 and 103. The butt end portion 102 and the stock 68 may thus be dovetailed onto each other at the mating plates 101 and 103. A screw 107 extends through apertures 108 and 109 in the plates 101 and 103 and is threaded into a lug 110 as best seen in FIG. 1, for releasably retaining the butt end portion 102 on the stock 68 of the firearm.

The terminals 23 and 24 shown in, and discussed above in connection with, FIG. 1, may have resilient contact fingers projecting through apertures 112 and 113 in the stock plate 101 as shown in FIG. 10. The butt end portion plate 103 carries corresponding electrically insulated contacts 115 and 116 for connecting the contacts 23 and 24 and thus the power supply wires 25 and 26 to a portable, replenishable source of power, represented in FIG. 11 as series-connected battery cells by dotted outlines 118, with which the butt end portion is loaded or otherwise equipped.

Upon loosening of the screw 107 or other conveniently actuable fastening device, the butt end portion 102 may be slid from the stock 68 of the gun for convenient recharging of the batteries 118. Of course, exchangeable butt end portions of the type shown at 102 or otherwise within the scope of the subject invention may be provided so that each firearm always has charged batteries at its disposal. Structuring the power supply or its container in the form of a butt end portion as a natural extension of the firearm stock according to the currently discussed aspect of the subject invention, has the great advantage that the combat readiness of the firearm is considerably enhanced relative to prior-art proposals which, for instance, simply attached a cylindrical battery to the butt end of a firearm stock (see 894,306) or which attached the power supply externally of the firearm proper, such as in a separate attachable unit (see U.S. Pat. Nos. 1,452,651, 1,826,004, 2,844,710, 3,633,285, 3,867,764, 4,026,054 and 4,079,534).

At the same time, the currently discussed aspect of the subject invention avoids the space and battery capacity limitations implicit in proposals which suggested insertion of the battery in the stock proper or frame of the weapon itself (see U.S. Pat. Nos. 3,294,401 and 3,995,376, suggesting such an inclusion of batteries for a toy gun and a laser training device).

The subject invention and its various aspects and embodiments thus meet all the above mentioned objectives and provide firearms and aiming assistance devices that are particularly suited to the needs of law enforcement work, and that avoid the many drawbacks of prior-art proposals.

The subject extensive disclosure will suggest and render apparent to those skilled in the art various modifications and variations within the spirit and scope of the subject invention.

We claim:

1. In a method of operating a firearm having a firing device selectively actuable by a manually cockable hammer and a finger trigger for actuating said hammer and for releasing said cocked hammer for actuation of said firing device, with the aid of an aiming device activable via a switch to provide when activated an aiming mark on a target, the improvement comprising the steps of:

providing a switch with switch control means;

coupling said trigger to said switch control means for deactivating said aiming device in a rest position of said trigger;

manually cocking said hammer and decoupling said trigger from said switch control means for starting activation of said aiming device through said manual cocking of said hammer to provide said aiming mark; and releasing said cocked hammer with said finger trigger for actuation of said firing device only after activation of said aiming device and provision of said aiming mark.

2. A method as claimed in claim 1, including the step of:

activating said aiming device through manual actuation of said trigger to provide said aiming mark.

3. A method as claimed in claim 1, wherein:

said trigger is moved with said hammer during cocking of said hammer for decoupling said trigger from said switch control means.

4. In a method of operating a firearm having a firing device selectively actuable by a hammer and a finger trigger for actuating said hammer, with the aid of an aiming device activable via a switch to provide when activated an aiming mark on a target, the improvement comprising in combination the steps of:

providing a switch with switch control means;

coupling said trigger to said switch control means for deactivating said aiming device in a rest position of said trigger;

manually moving said finger trigger relative to said hammer;

starting activation of said aiming device with said moving finger trigger by decoupling said moving trigger from said switch control means to provide said aiming mark; and actuating said hammer with said finger trigger only after activation of said aiming device and provision of said aiming mark.

5. A method as claimed in claim 4, including the steps of:

cocking said hammer;

retaining said cocked hammer in a cocked position; and releasing said hammer from said cocked position with said finger trigger only after activation of said aiming device and provision of said aiming mark.

6. A method as claimed in claim 4, including the step of:

providing a releasable safety stop for said finger trigger for selectively preventing actuation of said hammer with said finger trigger;

providing play between said finger trigger and safety stop;

manually actuating said finger trigger toward said safety stop; and starting activation of said aiming device with said finger trigger in the course of said play.

7. A method as claimed in claim 1, 2, 3, 4, 5 or 6, wherein:

said aiming device is provided as a laser beam emitting device mounted on said firearm; and said aiming mark is provided by said laser beam emitting device as a light spot on the target upon activation of said aiming device.

8. In a method of aiming a firearm having a firing mechanism actuated by a manually actuable trigger, with the aid of an aiming device activable via a switch to provide when activated an aiming mark on a target, the improvement comprising in combination the steps of:

providing said trigger with play between initial manual actuation of said trigger and actuation of said firing mechanism by said trigger;

providing a switch with switch control means;

coupling said trigger to said switch control means for deactivating said aiming device in a rest position of said trigger; and activating said aiming device with said trigger by decoupling said trigger from said switch control means in the course of said play.

9. A method as claimed in claim 8, wherein:

said aiming device is provided as a laser beam emitting device mounted on said firearm; and said laser beam emitting device is energized with said trigger by decoupling said trigger from said switch control means in the course of said play to provide said aiming mark as a light spot on the target.

10. A method as claimed in claim 1, 2, 3, 4, 5, 6, 8 or 9, wherein:

said firearm is provided with a stock having an end portion extending over a cross-section of said stock, and with a butt end portion extending over said cross-section and being manually detachable from said stock;

said butt end portion is loaded with a replenishable power source for activating said aiming device; and said aiming device is energized from said power source when said butt end portion is attached to said stock.

11. In a firearm, the improvement comprising in combination:

a firing device;

means including a trigger and a manually cockable and selectively releasable hammer for actuating said firing device;

activable means for providing when activated an aiming mark on a target;

a switch for activating said activable means;

control means for said switch coupled to said trigger for inhibiting activation of said activable means in a rest position of said trigger;

means coupled to said switch control means and to said hammer for starting activation of said aiming mark providing means through manual cocking of said hammer to provide said aiming mark, including means for decoupling said switch control means from said trigger in response to cocking of said hammer; and means including said trigger for releasing said cocked hammer into actuation of said firing device only after activation of said aiming device and provision of said aiming mark.

12. A firearm as claimed in claim 11, wherein:

said activation starting means are coupled to said hammer via said finger trigger.

13. A firearm as claimed in claim 11 or 12, including:

means for providing a lost-motion connection between said finger trigger and said hammer.

14. A firearm as claimed in claim 11, wherein:

said hammer includes means for moving said finger trigger during cocking of said hammer;

said activation starting means include means coupled to said trigger for starting activation of said aiming device through said moving trigger to provide said aiming mark.

15. A firearm as claimed 11, 12 or 14, including:

means in said activation starting means for starting activation of said aiming device through manual actuation of said trigger to provide said aiming mark; and means for actuating said hammer from a rest position with said finger trigger;

means for providing play between said finger trigger and said hammer; and means coupled to said finger trigger for activating said aiming device in the course of said play.

16. A firearm as claimed in claim 11, 12 or 14, wherein:

said aiming device includes a laser beam emitting device mounted on said firearm for providing said aiming mark as a light spot on the target.

17. Apparatus for assisting the aiming of a firearm having a firing mechanism actuated by a manually actuable trigger, comprising in combination:

activable means for providing when activated an aiming mark on a target;

means at said trigger for providing said trigger with play between initial manual actuation of said trigger and actuation of said firing mechanism by said trigger; and means connected to said activable means and coupled to said trigger for activating said aiming mark providing means, including a switch for activating said activable means, control means for said switch coupled to said trigger for inhibiting activation of said activable means in a rest position of said trigger, and means for decoupling said switch control means from said trigger to activate said aiming mark providing means in the course of said play.

18. Apparatus as claimed in claim 17, wherein:

said firing mechanism includes a hammer having an actuating member located at a distance from said trigger for engagement and actuation by said trigger, and means for pivoting said trigger for travel through said distance into engagement with said actuating member; and said activating means includes means for activating said aiming mark providing means upon initiation of said travel.

19. Apparatus as claimed in claim 17, wherein:

said firing mechanism includes a manually cockable hammer having an extension for engaging and moving said trigger during cocking of said hammer;

said trigger has a portion for releasably retaining said extension of said hammer upon completed movement of said trigger by said extension and cocking of said hammer, preparatory to manual actuation of said trigger and release of said cocked hammer; and said activating means include means for activating said aiming mark providing means upon movement of said trigger by said extension during cocking of said hammer.

20. Apparatus as claimed in claim 17, wherein:

said firing mechanism includes a manually cockable hammer having an actuating member located at a distance from said trigger for engagement and actuation by said trigger and an extension for engaging and moving said trigger during cocking of said hammer, and means for pivoting said trigger for travel through said distance into engagement with said actuating member and for movement of said trigger during cocking of said hammer;

said trigger has a portion for releasably retaining said extension of said hammer upon completed movement of said trigger by said extension and cocking of said hammer, preparatory to manual actuation of said trigger and release of said cocked hammer; and said activating means include means for activating said aiming mark providing means upon initiation of said travel and upon said movement of said trigger.

21. Apparatus as claimed in claim 17, wherein:

said firing mechanism has a selectively actuable safety device for stopping said trigger in the course of said play; and said activating means include means for activating said aiming mark providing means prior to said stopping of said trigger by said safety device.

22. Apparatus as claimed in claim 17, wherein:

said aiming mark providing means include an energizable laser device mounted on said firearm for emitting when energized a laser beam to provide said aiming mark in the form of a light spot on said target; and said activating means include a switching device electrically connected to said laser device and mechanically coupled to said trigger for energizing said laser device in the course of said play.

23. A method as claimed in claim 17, wherein:

said firearm has a stock including an end portion extending over a cross-section of said stock;

said firearm includes means for receiving a replenishable power source for activating said aiming mark providing means, including a hollow butt end portion extending over said cross-section and being manually detachable from said stock; and said activating means include means coupled to said trigger for energizing said aiming mark providing means from said power source in the course of said play when said butt end portion is attached to said stock.

24. In a method of aiming a firearm with the aid of an aiming device controlled by a switch to provide an aiming mark on a target, said firearm having a manually actuable trigger assembly and means engageable by said assembly for controlling said switch, the improvement comprising in combination the steps of:

effecting an engagement between said trigger assembly and said engageable means in a rest position of the trigger assembly;

controlling said switch in response to said engagement to suspend operation of said aiming device in said rest position;

effecting a disengagement between said trigger assembly and said engageable means upon manual actuation of the trigger assembly from said rest position; and controlling said switch in response to said disengagement to provide said aiming mark upon said manual actuation of the trigger assembly from said rest position.

25. A method as claimed in claim 24, including the steps of:

providing said engageable means with a bias tending to close said switch;

maintaining said engageable means against said bias during said engagement between the trigger assembly and said engageable means; and closing the switch with said bias upon said disengagement between the trigger assembly and said engageable means.

26. A method as claimed in claim 24, including the steps of:

providing said engageable means with a lever extending from said trigger assembly to said switch; and employing said lever to maintain said switch open in said rest position of the trigger assembly.

27. In a method of aiming a firearm with the aid of an aiming device activated upon closure of a switch to provide an aiming mark on a target, said firearm having a manually actuable trigger assembly, the improvement comprising in combination the steps of:

providing means for actuating said switch;

providing said trigger assembly with an element engageable with said actuating means;

engaging said actuating means with said trigger assembly element to maintain said switch open in a quiescent condition of the firearm;

disengaging said trigger assembly element from said actuating means upon manual actuation of the trigger assembly; and closing said switch with said disengaged actuating means to provide said aiming mark.

28. A method as claimed in claim 27, including the steps of:

providing said means for actuating said switch with a lever extending from said trigger assembly to said switch; and employing said lever to maintain said switch open in a quiescent condition of the firearm.

29. A method as claimed in claim 28, including the step of:

pivoting said lever for angular movement between said trigger assembly and said switch.

30. A method as claimed in claim 28 or 29, including the steps of:

providing said trigger assembly with a cam surface at said element engageable with said lever; and engaging with said trigger assembly said lever via said cam surface to maintain said switch open in said quiescent condition.

31. A method as claimed in claim 30, including the steps of:

lifting said cam surface off said lever upon manual actuation of the trigger assembly; and closing said switch with said lever upon said lifting of the cam surface.

32. In a method of aiming a firearm with the aid of an aiming device activated upon closure of a switch to provide an aiming mark on a target, said firearm having a manually actuable trigger assembly, the improvement comprising in combination the steps of:

providing said switch as a normally closed switch;

providing said trigger assembly with an element extending to said switch for maintaining said normally closed switch in an open condition in a quiescent condition of the firearm; and employing said element to release said switch to its normally closed condition to provide said aiming mark upon manual actuation of the trigger assembly.

33. In apparatus for assisting the aiming of a firearm having a manually actuable trigger assembly, the improvement comprising in combination:

a switch;

an aiming device controlled by said switch for providing an aiming mark on a target;

means engageable by said trigger assembly for controlling said switch;

means for effecting an engagement between said trigger assembly and said engageable means in a rest position of the trigger assembly;

means for controlling said switch in response to said engagement to suspend operation of said aiming device in said rest position;

means for effecting a disengagement between said trigger assembly and said engageable means upon manual actuation of the trigger assembly from said rest position; and means for controlling said switch in response to said disengagement to provide said aiming mark upon said manual actuation of the trigger assembly from said rest position.

34. Apparatus as claimed in claim 33, including:

means for imposing on said engageable means a bias for closing the switch upon said disengagement between the trigger assembly and said engageable means; and means coupled to said engageable means for maintaining said engageable means against said bias during said engagement between the trigger assembly and said engageable means.

35. Apparatus as claimed in claim 33, wherein:

said engageable means include a lever extending from said trigger assembly to said switch and maintaining said switch open in said rest position of the trigger assembly.

36. In apparatus for assisting the aiming of a firearm having a manually actuable trigger assembly, the improvement comprising in combination:

a switch;

an aiming device activated upon closure of said switch for providing an aiming mark on a target;

means for actuating said switch;

means including an element at said trigger assembly engageable with said actuating means for maintaining said switch open in a quiescent condition of the firearm;

means for mounting said trigger assembly element for disengagement from said actuating means upon manual actuation of the trigger assembly; and means for closing said switch with said disengaged actuating means to provide said aiming mark.

37. Apparatus as claimed in claim 36, wherein:

said means for actuating said switch include a lever extending from said trigger assembly to said switch for maintaining said switch open in a quiescent condition of the firearm.

38. Apparatus as claimed in claim 37, wherein:

said switch actuating means include means for pivoting said lever for angular movement between said trigger assembly and said switch.

39. Apparatus as claimed in claim 37 or 38, wherein:

said trigger assembly element has a cam surface engageable with said lever for maintaining said switch open in said quiescent condition.

40. Apparatus as claimed in claim 39, including:

means for lifting said cam surface off said lever upon manual actuation of the trigger assembly; and means for closing said switch with said lever upon said lifting of the cam surface.

41. In apparatus for assisting the aiming of a firearm having a manually actuable trigger assembly, the improvement comprising in combination:

a normally closed switch;

an aiming device activated upon closure of said switch to provide an aiming mark on a target; and means at said trigger assembly extending to said switch for maintaining said normally closed switch in an open condition in a quiescent condition of the firearm and for releasing said switch to its normally closed condition to provide said aiming mark upon manual actuation of the trigger assembly.

* * * * *